US006194700B1

(12) United States Patent
Pradere et al.

(10) Patent No.: US 6,194,700 B1
(45) Date of Patent: Feb. 27, 2001

(54) DEVICE WITH AN ALTERATION MEANS FOR THE CONVERSION OF AN IMAGE

(75) Inventors: Philippe Pradere, Izeaux; Paul de Groot, St. Ismier, both of (FR)

(73) Assignee: Thomson Tubes Electroniques, Meudon la Foret (FR)

( * ) Notice: Subject to any disclaimer, the term of this patent is extended or adjusted under 35 U.S.C. 154(b) by 0 days.

(21) Appl. No.: 09/286,443

(22) Filed: Apr. 6, 1999

(30) Foreign Application Priority Data

Apr. 7, 1998 (FR) ..... 98 04309

(51) Int. Cl.[7] ..... H01J 40/14
(52) U.S. Cl. ..... 250/214 VT; 313/530
(58) Field of Search ..... 250/214 VT, 207, 250/208.1; 313/530, 542, 544, 103 CM, 104

(56) References Cited

U.S. PATENT DOCUMENTS

| | | | |
|---|---|---|---|
| 4,749,903 | 6/1988 | Munier et al. | 313/366 |
| 4,751,423 | 6/1988 | Munter et al. | 313/366 |
| 4,829,355 | 5/1989 | Munier et al. . | |
| 4,943,254 | 7/1990 | Vieux et al. . | |
| 4,960,608 | 10/1990 | Vieux et al. . | |
| 4,980,561 | 12/1990 | Vieux et al. | 250/486.1 |
| 4,985,633 | 1/1991 | Vieux et al. | 250/486.1 |
| 5,146,076 | 9/1992 | Raverdy et al. | 250/214 VT |
| 5,298,294 | 3/1994 | Vieux et al. . | |
| 5,319,189 | 6/1994 | Beauvais et al. | 250/214 VT |
| 5,338,927 | 8/1994 | de Groot et al. | 250/214 VT |
| 5,449,449 | 9/1995 | Vieux et al. . | |
| 5,567,929 * | 10/1996 | Ouimette | 250/214 VT |
| 5,631,459 | 5/1997 | de Groot | 250/214 VT |

FOREIGN PATENT DOCUMENTS 35 33 582 A1 4/1987 (DE) .

* cited by examiner

*Primary Examiner*—Que T. Le
(74) *Attorney, Agent, or Firm*—Oblon, Spivak, McClelland, Maier & Neustadt, P.C.

(57) ABSTRACT

To reduce phenomena of distortion in an image intensifier tube, it is planned to provide its input with a permanent test pattern. The image of the test pattern is then read in real time and a deduction is made therefrom of the correction to be made to an image transmitted and converted by this intensifier tube. To create a permanent test pattern, references are made on the intensifier tube, on its input window. As a variant, the references are produced by an auxiliary laser source that illuminates the cathode of the tube by the rear.

11 Claims, 3 Drawing Sheets

DEVICE WITH AN ALTERATION MEANS FOR THE CONVERSION OF AN IMAGE

BACKGROUND OF THE INVENTION

1. Field of the Invention

An object of the present invention is a device for the conversion of an image. The conversion made is that of an image, transmitted by electromagnetic radiation, into an electronic image. In a preferred example, the electromagnetic radiation is an X-radiation. However, it may be a radiation in the visual domain. The field of the invention is chiefly that of radiological image intensifiers or RII. It may also be that of light image intensifiers or LII. Intensifiers of this kind, in addition to conversion, carry out an amplification of the image signal.

2. Description of the Prior Art

FIG. 1 shows an image intensifier device. For example, in the medical field, an X-ray tube 1 irradiates the body 2 of a patient. An anti-scattering grid 3 eliminates the rays that are not radial from the X-radiation going through the body 2. In an electron tube 4, a photocathode 5 delivers electrons focused on a target 6. The photocathode is excited by the radiation to be converted and locally, at each place where it is excited, produces an electron radiation whose intensity is proportional to the intensity of the incident electromagnetic radiation. In the field of radiology, the photocathode is associated with a scintillator that converts the X-rays, which have very short wavelengths, into electromagnetic rays that have a greater wavelength and are capable of exciting the photocathode 5. The electrons are attracted towards the target by the presence of an anode. The electrons are furthermore subjected to deflections imposed by an electrical focusing field. The electrical field is induced by a set of electrodes 7 taken to appropriate levels.

When they are liberated from the photocathode 5, the speed of the electrons is very low. The speed of the electrons, combined with their charge, constitutes an electrical current. The electrons are then unfortunately, according to Lenz's law, subjected to parasitic deflections dictated by all the existing magnetic fields on their paths. The most widely known deleterious magnetic field is that resulting from the earth's magnetic field.

The focusing device itself contributes known deformations to the image. The correction of these deformations has already been considered in the prior art. The best known deformation is the pincushion distortion. It is due to the spherical nature of the input face of the tube 4. It is possible, with correction electrodes as well as with target-reading electronic devices, to correct it accordingly.

The deformation dictated by parasitic magnetic influences is an S deformation. It has a twofold effect. Firstly, with respect to a component, transversal to the focusing axis, of the deleterious magnetic field, it results in a substantially homogeneous (first order) translation of all the points, or pixels, of the image on the target. Secondly, with respect to the axial component of the deleterious magnetic field, it gets combined with the component, transversal to the focusing axis, of the speed of the electrons. It leads to a differential rotation of the image around the focusing axis. The amplitude of this rotation depends on the transversal component of speed and the non-homogeneous attenuation of the magnetic shielding of the tube. It is known that, under these conditions, the rotational distortion of the pixels of the image obtained is all the greater as the distance of these pixels from the center of the image is small.

Compensation for these latter distortions has been envisaged in the prior art. A first approach has consisted in providing an envelope 8 of the image intensifier tube with a layer of magnetic material to channel the disturbing magnetic fields in this layer. The best known magnetic material used is $\mu$ metal. This $\mu$ metal is an alloy of nickel and iron that concentrates the field lines. It is thus possible to provide the input 9 of the tube with a layer of magnetic material of this kind, but with a very small thickness, in order to obtain better protection.

In order to try and eliminate the most harmful effects of the axial component of the terrestrial magnetic field, it has even been planned to place a coil 10 very close to the input of the tube 4 producing an axial magnetic field but with a value opposite the value of the axial component of the terrestrial magnetic field. Whereas, without correction, the rotations of the pixels under the effect of the distortion may be about 10 mm, with these compensation means, they may be reduced by half. However, in the case of high-resolution images, where the size of a pixel is about 200 to 300 micrometers, a distortion of this kind is still equivalent to a distance of 15 to 25 pixels. This is far too much for certain applications.

The target 6 consists of a layer of luminophors that emit light under the excitation of electron rays, by cathodoluminescence effect. The image formed on the target 6 is then read by different devices. For example, it may be read by a cinema camera 11. In this case, a succession of images produced on the target 6 is recorded. The image may also be read, if it is unique, by a photographic apparatus 12. In a preferred solution of the invention, the image is read by a television camera 13. In particular, the camera 13 digitizes the image.

Within the framework of this preferred use, there is a known way of correcting the distortions resulting from the parasitic influences of the magnetic field by using a digital image processor 14 linked with the camera 13. The corrected image or the unprocessed image is presented on a monitor 15. The principle of the correction consists in reading an image of a test pattern placed in the path of the electromagnetic radiation, for example; in the input plane 9 of the RII. The test pattern is known by construction and constitutes the reference of the non-distorted image. With the series of elements 4, 13, 15, the image of the test pattern obtained reveals the distortions due to the magnetic field in the conditions of acquisition. The processor 14 then compares the perfect image of the test pattern with the revealed image of the test pattern. This comparison gives a piece of information on the distortion undergone by the image and imposed by the series of elements 4, 13, 15. From this distortion information, it is possible to compute a reverse distortion function. The reverse distortion function is then applied to the digital image of the patient's body 2 delivered by the camera 13 in order to correct it.

This technique is implemented especially in tomodensitometers. Indeed, for these instruments, on the one hand, a precision of one-tenth of a pixel is sought. On the other hand, fortunately for these machines, the orientations of the tube 4 in space with respect to the earth's magnetic field can easily be identified. Indeed, machines of this kind have an axis of rotation, with the tube 4 having to occupy predetermined radial positions around this axis of rotation. It is therefore possible, for each rotation of the tube 4 about this axis of rotation, to detect a reverse distortion function and index the correction of the images delivered by the tomodensitometer as a function of this angle of orientation during the acquisition.

However, a technique of this kind cannot be used in an apparatus for which the position of the RII is not identified, especially in the context of radiology instruments comprising an arm incurvated in the form of an arc of a circle on which the tube 4 shifts rotationally. These instruments are commonly called C-arms. Indeed, this incurvated arm is itself fixed to a shaft that enables the rotation of this arm around a second axis of rotation perpendicular to the axis of rotation of the tube 4 along the incurvated arm. Furthermore, the arm is itself mounted on a rotational pivot. Consequently, the tube 4 has three degrees of freedom in rotation. For each of these degrees, the tube 4, depending on need, may occupy any place. Consequently, the map of the reverse distortion functions to be detected is infinite. In practice, this approach cannot be used for instruments of this type.

It is an object of the invention to overcome this problem by noting that the useful images are not permanently acquired by the tube 4. In the invention, an image of the test pattern is then acquired almost in real time, during, before or after the acquisition of each image of the body. To achieve this more easily, the invention comprises means mounted fixedly in the tube 4 to constitute an image of the test pattern in real time. In one example, this can be achieved in two ways. Firstly, a periodic pattern, or a grid, that alters all the images in a known way is incorporated into the input of the tube. The alteration occurs geographically at places whose position on a theoretical image (without distortion) is known beforehand. The effects of these alterations in the real image are registered and compared with the theoretical image and a correction to be made to the useful image of the body is deduced therefrom. In another mode, the alteration is not permanent. It may or may not be provided in real time to the useful image. For example, the photocathode is illuminated intermittently with an auxiliary light radiation producing therein traces that represent the grid. Or else, the image of the test pattern is scrambled in the useful image during the acquisition of the useful image, and then the image of the test pattern is not scrambled during the acquisition of the image of the test pattern. According to the invention, in these cases of definitive or non-definitive alteration, it is possible to obtain an alternating reading of the useful image and of the image of the test pattern. In these two cases, it will be seen that it is also possible to carry out a simultaneous reading of the two images.

SUMMARY OF THE INVENTION

An object of the invention therefore is a device for the conversion of an image transmitted by electromagnetic radiation into an electronic image comprising, in an electron tube, a photocathode excited by the electromagnetic radiation, a target and means for the focusing, on the target, of the paths of electrons produced by the photocathode, wherein the device comprises alteration means integrated into the tube, to locally alter a rate of the electromagnetic-electronic conversion and produce an electronic image with contrasting zones at the position of the local alterations and means for the alternating preparation, in real time, of the altered image and of the corrected image of the transmitted image.

BRIEF DESCRIPTION OF THE DRAWINGS

The invention will be understood more clearly from the following description and the accompanying figures which are given purely by way of an indication and in no way restrict the scope of the invention. Of these figures.

MORE DETAILED DESCRIPTION

Figure 1:
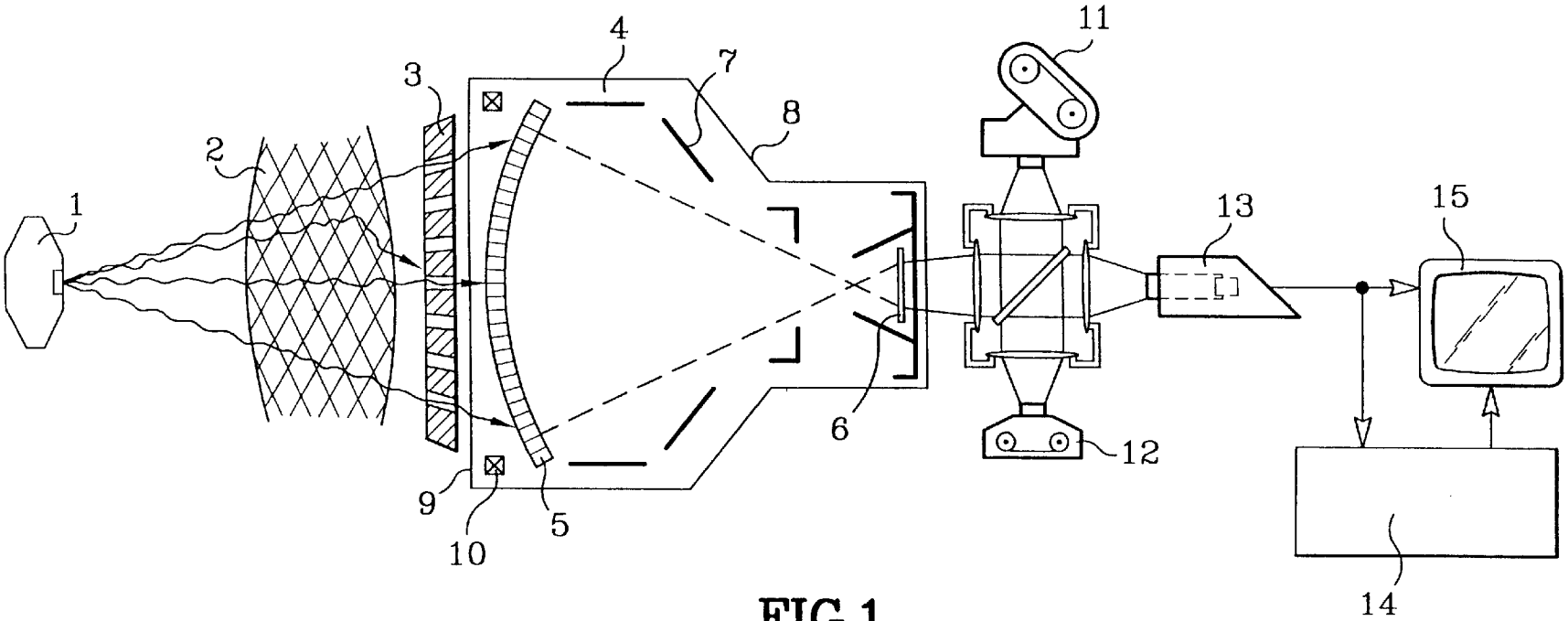
FIG. 1 already commented upon, shows an image intensifier that can be used in the invention as a conversion device.
Figure 2:
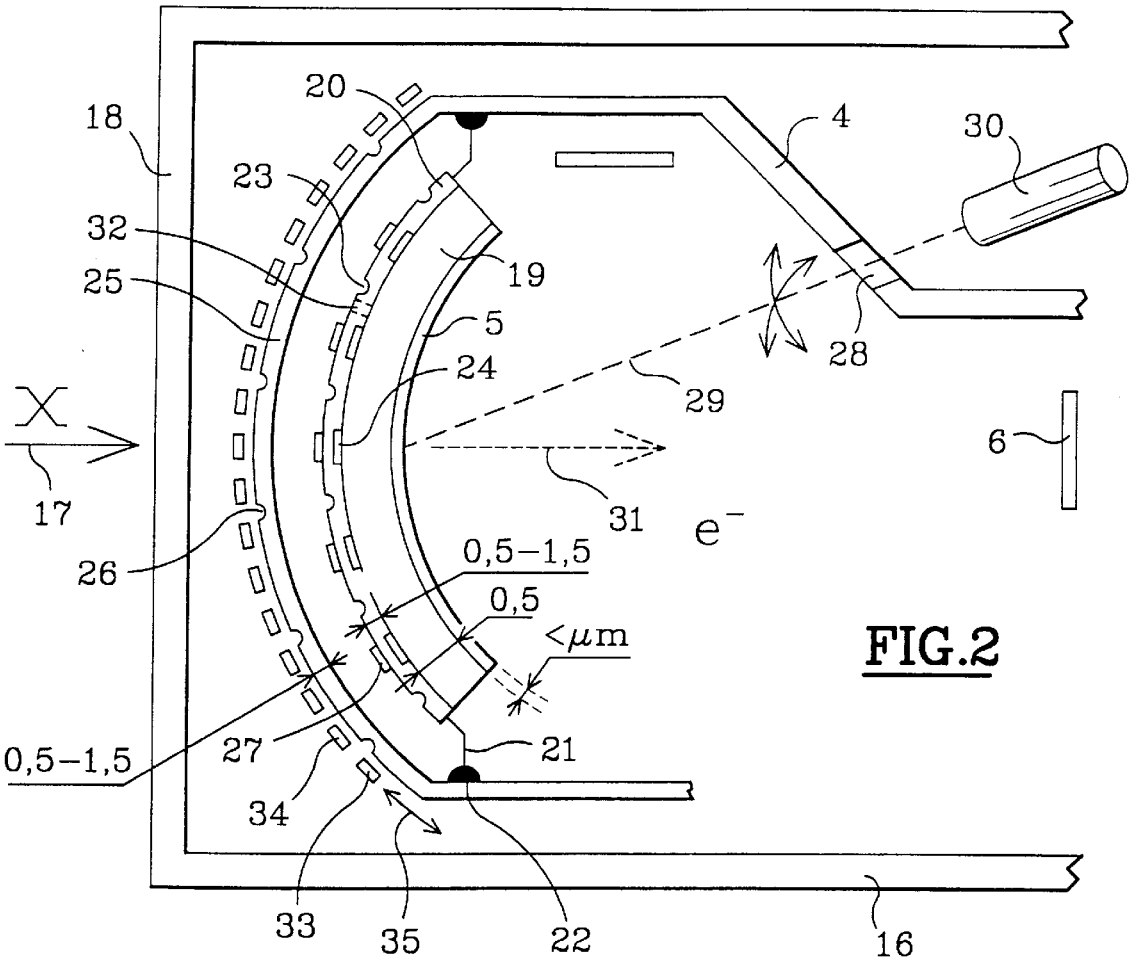
FIG. 2 shows an improvement provided by the invention to the device of FIG. 1.

FIG. 2 shows the improvement provided to the device of FIG. 1 within the framework of the invention. The figure shows the tube 4, the photocathode 5 and the target 6. The tube 4 is mounted in a box 16. The electromagnetic rays 17, which are for example X-rays, penetrate the box 16 through an input face 18 corresponding to the reference 9 in FIG. 1. The input face 18 is made for example of aluminum or plastic. In one example, the envelope 4 of the tube is made of stainless steel. Formerly, the tube 4 was made of glass. Within the framework of the radiological application, the photocathode formed by a layer of material Sb-K2-Cs is attached to a scintillator 19 which, in a preferred solution, is cesium iodide CsI. The scintillator 19 is itself borne by a support 20 which, in one example, is made of aluminum. The envelope 4 of the tube at the position where this tube receives the electromagnetic rays has a thickness of 0.5 mm to 1.5 mm. The support 20 of the scintillator 19 also has a thickness of 0.5 mm to 1.5 mm. In one example, the thickness of the layer of the scintillator 19 is about 0.5 mm. The thickness of the layer of the photocathode 5 is smaller than 1 micrometer.

In order to keep the photocathode 5 on the tube 4, its support 20 is fixed thereto by lugs 21 and ceramic pellets 22. The chips 22 are insulating and are designed to electrically insulate the photocathode 5 taken to zero voltage with respect to the envelope of the tube 4 which for its part is taken to a voltage of 100 to 300 volts.

In a first exemplary embodiment of the improvement of the invention, to make the references of one test pattern, the support 20 comprises deformations 23. For example, the deformations 23 are grooves or holes (not through holes) located on the face of the support 20 which receives the radiation 17. In one example, the depth of these grooves or holes is about 0.2 mm. At the position of these holes, the absorbent capacity of the support 20 is reduced. The result thereof is a modification of the image formed on the target 6. As a first variant, these hollow deformations 23 are replaced by other hollow deformations 24 made on the face of the support 20 in between this support 20 and the scintillator 19 (or the photocathode 5 which is curved). In this first variant, the resulting reduction of absorption is increased by the deformation, as the case may be, of the growth of CsI at this place. The resulting spot of the image is therefore increased. In a second variant, an input window 25 of the tube 4, formed by the part of the envelope 4 of the tube that faces the input face 18, comprises grooves or holes 26 fulfilling the same role as the holes or grooves 23 and 24. However, the gap between the support 20 and the input face 25 may result in a parallax error. On the contrary it has been seen that the making of references on the input face 18 does not lead to results that can be exploited owing to an excessively great parallax error.

These positive type deformations which comprehensively produce a greater transparency of the input of the tube may be made in particular by swaging or etching. They may be replaced by deformations acting in the negative sense. For example, protuberances 27 may be made on the face of the support 20 that receives radiations 27. These protuberances may also be made on the internal face of the window 25 of the tube 4 with; in this case, the risk of parallax error mentioned. The holes and grooves may be made by tools such as mills or drills. These holes and grooves as well as the protuberances may also be made by punching or stamping. In this case, the stiffness of the flanks of the groove may be attenuated. It will be seen hereafter that this defect has no effect. The distortion references may also be obtained by setting up, instead of the protuberances 27, deposits of more absorbent material or conversely, at other places, deposits of less absorbent material. These deposits may be paint markings. The latter may be obtained by printing or deposition after chemical etching of a layer of photoresist or polymer deposited on the surface to be treated. The marking may be made on an input face of the tube, or on faces of layers of materials interposed between this face and the photocathode. It is also possible to provide for the inclusion, in the support 20 or the input face 25 of the tube 4, of beads of material that are transparent in varying degrees to the radiation to be received with the converter.

In another method for obtaining the test pattern, it is planned to make a window 28 in the envelope 4 of the tube. The window 28 is outside the field of radiation to be converted. Through this window 28, a laser radiation 29 (essentially a single ray, especially if the source is not a laser source), produced for example by a laser source 30, illuminates the rear face of the photocathode 5. Under the effect of this illumination, it emits an electron radiation 31 revealing the place where it has been excited by the ray 29. It is possible to obtain a scanning of the rear of the photocathode 5 through the ray 29. Preferably, the emission of the source 30 will be pulsed. For example, for a 400 mm by 400 mm image where references, deformations or luminous marks are provided every 20 mm, it is necessary to produce 400 marks in the signal of an image. In the framework of an application in radioscopy or radiography with 15 images per second, the duration of a shot of a radiological image is about 5 ms. Each radiographic image is separated from a following radiographic image by a temporal interval during which an acquisition of the image of the test pattern is carried out. Given the power of the source 30, it is possible that the signal delivered by the photocathode 5 will in this case be far greater than that delivered by the photocathode 5 by means of X-rays. It can be estimated that the duration of acquisition of the distorted image of the test pattern is 5 ms. For the 400 marks, the laser source 30 must therefore be pulsed at a frequency of 80 KHz. It will be noted that, with respect to the position of the source 30, it is possible to do without the window 28 and place it within the envelope of the tube 4.

Rather than illuminate the photocathode 5 by the rear, it may be planned to let through an auxiliary light radiation by means of through holes 32 made throughout the thickness of the support 20. These holes are made with a desired density.

Figure 3A:
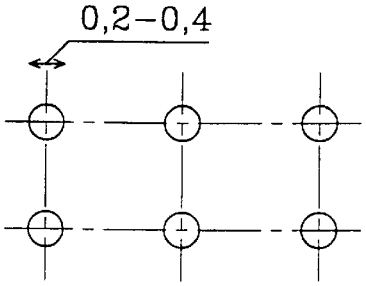
FIGS. 3*a* to 4*b* are examples of test patterns that can be used in the device of the invention and their distorted images.
Figure 3B:
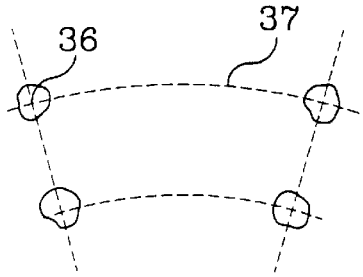

A third mode of implementation of the invention comprises the making of a grid 33 whose shape perfectly matches the spherical shape of the input window 25. This grid 33 may slide in alternation on the input window 25. The principle of acquisition with this third mode consists in mobilizing the grid, for example making it shift during the useful shot. In this case, bars 34 of the grid 33 distribute their absorption effect throughout the image which is thereby affected uniformly. At the time of acquisition of the image of the test pattern, it is constituted by the grid 33 stopped in a particular position. Means, symbolized by an arrow 35, for moving the grid 33 may comprise an electromagnetic vibrating element FIGS. 3*a* and 3*b* show the shape of the deformations, marks and round-shaped light spots recommended in the invention respectively before and after conversion. For example, a diameter will be chosen for these references that is equal to the size, corresponding to the RII input face 9, of 2 to 4 pixels. FIG. 3*b* shows the electronic image made on the target 6 in correspondence with these references. The images of these references are imperfectly deformed on the one hand and their positions in the image are distorted on the other hand. When localized references are made, a search is made, for the purpose of correcting the distortion of the images, to obtain the position of the center 36 of these spots. The alignments of these centers 36 make it possible to determine the distortions 37 of their alignments. The corrections to be made to the revealed images are deduced therefrom by interpolation.

Figure 4A:
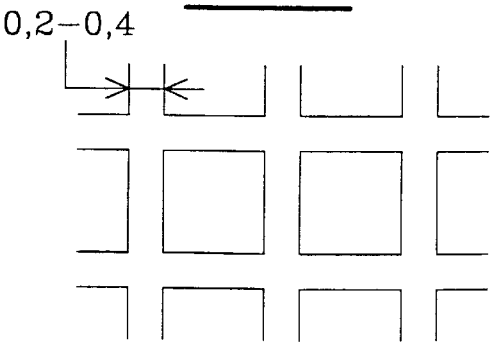
Figure 4B:
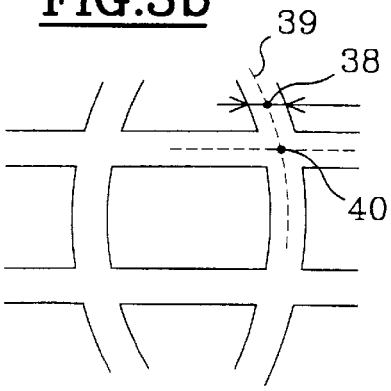

FIGS. 4*a* and 4*b* give a view, in the same conditions, of the effects of the replacement of the holes by grooves. The advantage of using the grooves is to enable a measurement of all the points 38 of the axes of the grooves and deduce therefrom the alignments 39 resulting from the image of these grooves. In this case, the intersections 40 of the alignments 39 may be estimated with far greater precision.

Figure 5:
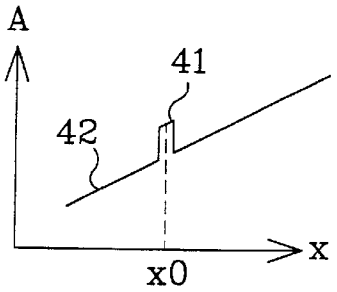
FIG. 5 shows a modification of an image signal due to the permanent presence of the test pattern.

FIG. 5 shows the evolution of the amplitude A of an electronic signal 42 detected on the target 6 as a function of an x-axis value on this target. This signal, which presents a evolution in the nature of the interposed body 2, shows a variation of amplitude 41 on the x-axis x0, in this case a positive variation, due to a reduction in the absorption of the electromagnetic radiation to be measured. A modification 41 of the signal could be negative if there should be excess thicknesses. Given the local nature of the variation of the signal 42, it is possible to process the image signal 42, for example by neighborhood, to eliminate the pulse 41 therefrom. It is possible thereafter, from the measured signal, to deduce the signal in which the pulse 41 has been eliminated. In this case, there remains a signal revealing the pulses 41 alone. Through this, it can be explained that that it is possible simultaneously to acquire the signal 42 pertaining to the transmitted image and the signal 41 pertaining to the image of the test pattern. Naturally, it is possible to obtain, cyclically in time, firstly the signal 42 and then alternately the signal 41 alone. This is the case for example of a variant with the light source 30 or the moving grid 33. In the case of permanent acquisition, it can be ensured that the pulse 41 will be small as compared with the dynamic range of the signal 42. The deduction of this signal 42, after filtering, may lead to obtaining an image of the signals 41 that is highly noise-infested. A choice will be made accordingly, firstly of the level of variation of absorption dictated by the permanent presence of the test pattern and, secondly, the number of holes and grooves to be made therein. The deeper the holes, the greater will be the contrast and the smaller will be the need for references. For shallow grooves, it shall be chosen to make them more numerous.

Figure 6:
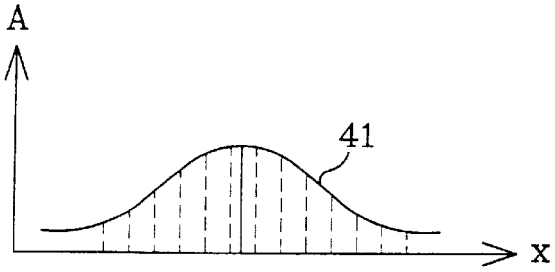
FIG. 6 shows a view of an appropriate method to obtain corrections as precise as a pixel fraction.

FIG. 6 shows that the defining of the alignments 39 may be used to obtain the places of the intersections 40 with a precision greater than a fraction of a pixel. The pulse 41, which herein is considerably increased, gives rise to a Gaussian curve shape. There is a known way of finding the position of the mean in terms of x-axis coordinates.

Figure 7:
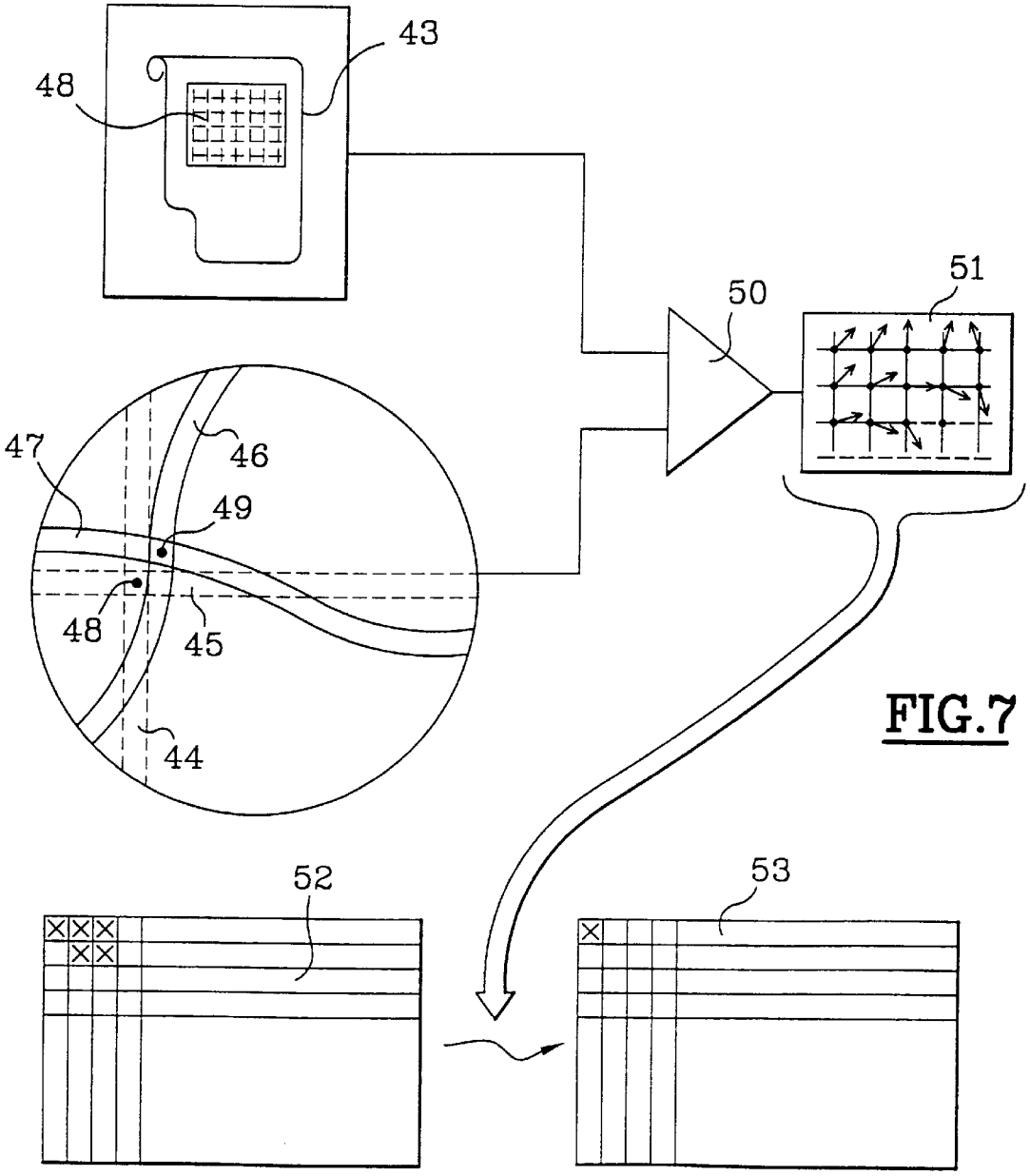
FIG. 7 is an illustration of a real-time implementation of the invention.

FIG. 7 shows the principle of the invention. In the laboratory, during a calibration experiment, the perfect image of the test pattern is measured. To this end, the converter, the image intensifier, is placed in a room that is completely insulated from the deleterious magnetic field, especially from the earth's magnetic field. For example, the walls of the room are covered with a layer of $\mu$ metal that concentrates the magnetic field. The image thus obtained of the test pattern is memorized in a memory 43 of the image processor 14. This memorized image is for example a file registering a collection of addresses, x-axis values and y-axis values corresponding to the points of the grid forming the test pattern. At the time of use, an acquisition is made alternately (or at the same time) of the useful image, that of the patient 2 for example, and that of the test pattern. These images comprise identical deformations. Owing to the position in space of the tube 4 and the disturbances communicated to it, in this position, by the earth's magnetic field, the grooves 44, 45 made on this test pattern get converted into images 46 and 47 respectively on the target 6. The resultant deformations are comprehensively S-shaped deformations. It is observed that the point 48 of concurrence of the grooves 44 and 45, whose position is known by the memory 43, has shifted to the position 49. The processor 14 is capable of processing the image of FIG. 3*b* or FIG. 4*b* to prepare the coordinates of the images 49 of the points of concurrence 48. This preparing is of a known type. It is implemented in the application to tomodensitometers referred to here above. Starting from the perfect image of the test pattern stored in the memory 43 and the image, acquired in real time, of the test pattern, the processor 14 performs a comparison 50 and produces a reverse distortion function 51. This reverse distortion function 51 is then applied to the useful image 52 of the patient 2 to produce the corrected image 53 by correction. This correction is also of a type that is known in the previous application.

The references obtained in the invention must have a preferably low contrast so as not to saturate the useful image acquired at the same time as these references. Indeed, cf. FIG. 6, the saturation does not enable a search for the position of the mean. By contrast, in alternating acquisition, especially with the source 30 or with the illumination by an auxiliary source through the holes 32, it is possible to accept signals with greater contrast.

Owing to the measurement of the image of the distorted test pattern, it is thereafter possible to make the acquired image undergo a processing operation in which this distorted test pattern image is removed, the result of which is that the transmitted image alone is taken into account.

What is claimed is:

1. A device for the conversion of an image transmitted by electromagnetic radiation into an electronic image comprising, in an electron tube, a photocathode excited by the electromagnetic radiation, a target and means for the focusing, on the target, of the paths of electrons produced by the photocathode, wherein the device comprises alteration means integrated into the tube, to locally alter a rate of the electromagnetic-electronic conversion and produce an electronic image with contrasting zones at the position of the local alterations and means for the alternating preparation, in real time, of the altered image and of the corrected image of the transmitted image.

2. A device according to claim 1, wherein the alteration means comprise local modifications of the transparency to electromagnetic radiation of an input face of the tube, or of layers of materials interposed between this input face and the photocathode.

3. A device according to claim 2, wherein the modification of the transparency is positive, by local reductions of thickness, especially by swaging or etching, or by the making of zones having a lower capacity to absorb the electromagnetic rays.

4. A device according to claim 2, wherein the modification of transparency is negative, by the addition of local excess thicknesses or by the making of zones with a greater local capacity to absorb the electromagnetic rays.

5. A device according to claim 4, comprising a marking made on an input face of the tube or on faces of layers of materials interposed between this face and the photocathode.

6. A device according to claim 1, wherein the photocathode is curved, wherein it comprises a scintillator attached to the photocathode and borne by a support and wherein the support of the scintillator possesses an intermediate surface between this support and this scintillator, this intermediate surface being provided with local deformations forming alteration means.

7. A device according to claim 1, wherein the alteration means comprise means to locally excite the photocathode with an auxiliary electromagnetic radiation.

8. A device according to claim 7, wherein the exciting means comprises local drilled holes in a support bearing a scintillator attached to the photocathode.

9. A device according to claim 7, wherein the exciting means comprise a source of a light ray exciting the photocathode by one of its faces opposite the face excited by the electromagnetic radiation.

10. A device according to claim 9, wherein tube comprises a window to make this light ray penetrate therein.

11. A device according to claim 1, wherein an input window of the tube comprises a vibrating grid and means firstly to cyclically convey motion to it, for a duration corresponding to a conversion of the transmitted image and secondly to keep it fixed for a duration corresponding to a reading of the image of the grid.

* * * * *